US007852305B2

(12) United States Patent
Tsai

(10) Patent No.: US 7,852,305 B2
(45) Date of Patent: Dec. 14, 2010

(54) FLAT PANEL DISPLAY AND GATE DRIVING DEVICE FOR FLAT PANEL DISPLAY

(75) Inventor: Chin-Cheng Tsai, Tainan County (TW)

(73) Assignee: Chimei Innolux Corporation, Miao-li County (TW)

( * ) Notice: Subject to any disclaimer, the term of this patent is extended or adjusted under 35 U.S.C. 154(b) by 681 days.

(21) Appl. No.: 11/924,179

(22) Filed: Oct. 25, 2007

(65) Prior Publication Data

US 2008/0238852 A1 Oct. 2, 2008

(30) Foreign Application Priority Data

Mar. 29, 2007 (TW) ..... 96111106 A

(51) Int. Cl.
*G09G 3/36* (2006.01)

(52) U.S. Cl. ..... 345/98; 345/87; 345/211; 345/212; 345/213

(58) Field of Classification Search ..... 345/87, 345/98, 211–213
See application file for complete search history.

(56) References Cited

U.S. PATENT DOCUMENTS 5,745,092 A * 4/1998 Ito ..... 345/95
2005/0078076 A1* 4/2005 Kim et al. ..... 345/98
2008/0238851 A1* 10/2008 Chen ..... 345/98

* cited by examiner

*Primary Examiner*—Quan-Zhen Wang
*Assistant Examiner*—Sahlu Okebato

(57) ABSTRACT

A flat panel display includes pixel electrodes, multiplexers and a gate driver. The gate driver has an amorphous silicon gate structure and includes a displacement temporary storage unit having a plurality of shift registers each with a power supply source and a clock terminal. One of a first voltage and a second voltage is selected and transmitted to the power supply source, and one of the first voltage and a clock signal is selected and transmitted to the clock terminal according to an off-controlling signal for causing the pixel electrodes connected to the shift registers to discharge.

9 Claims, 16 Drawing Sheets

FLAT PANEL DISPLAY AND GATE DRIVING DEVICE FOR FLAT PANEL DISPLAY

This application claims the benefit of Taiwan application Serial No. 96111106, filed Mar. 29, 2007, the entirety of which is incorporated herein by reference.

BACKGROUND

The disclosure relates in general to a flat panel display, and more particularly, to a flat panel display, which uses a gate driving device manufactured by an amorphous silicon manufacturing process and can eliminate a residual image after the display is turned off.

In the typical LCD architecture, a residual image is frequently seen on the display, e.g., a LCD panel, after the LCD panel is turned off and the residual image cannot disappear until several seconds have elapsed. This phenomenon interferes with the visual feeling of the user, and the display quality of the LCD panel is deteriorated with time. Taking a thin-film transistor (TFT) LCD as an example, one of the reasons causing the residual image to occur after the LCD is turned off is that the discharging speed of the pixel electrodes of the TFT-LCD is too slow. Thus, the charges cannot be quickly released and remain in the liquid crystal capacitors after the LCD is turned off, and cannot be completely discharged until a period of time has elapsed.

FIG. 1 (Prior Art) is a schematic illustration showing a conventional LCD 10. In the LCD 10, a timing controller (not depicted in FIG. 1) outputs data, wherein a source driver of a display array circuit is utilized to receive and write the data, and gate drivers 12*y* (y=1 to P, and P is a positive integer) are utilized to select a row for writing the data so that an output frame is displayed on a panel 16. Then, when the LCD is turned off, a voltage detecting circuit 142 of a printed circuit board 14 detects that a received operation voltage VCC is lowered to a predetermined level (e.g., 0.7VCC), an off-controlling signal XAO is transformed from a high-level voltage H to a low-level voltage L and then outputted to the gate drivers 12*y* (y=1 to P). Thus, an output signal of each of the gate drivers 12*y* (y=1 to P) is transformed into the high-level voltage H to turn on TFTs of each pixel in the panel 16. FIG. 2 (Prior Art) shows signal waveforms in the LCD 10 of FIG. 1. Consequently, before the LCD is powered off, residual charges in a liquid crystal capacitor of each pixel can be rapidly discharged by the turned-on TFT and a data line electrically connected thereto. Thus, the time of completely discharging the residual charges can be shortened, thereby eliminating the phenomenon of the residual image when the LCD is turned off.

However, the property of the TFT-LCD is that a light source mainly comes from a backside, and a glass substrate has to be used. Thus, when the application field is an active mode LCD, transistors serving as switches have to be formed on the glass substrate using the semiconductor manufacturing process. However, the melting point of the glass is about 660° C., and the glass substrate cannot be used in the frequently used IC manufacturing process, such as the monocrystalline silicon manufacturing process (the growing temperature is higher than 1000° C.). In order to overcome this drawback, an amorphous silicon (Amorphous Si) manufacturing process, in which the amorphous silicon can be easily deposited on a large area and can be well attached to the glass substrate, is frequently used. FIG. 3 is a block diagram showing an amorphous silicon gate driver. As shown in FIG. 3, an amorphous silicon gate driver 300 has many shift registers 31*n* (n=1 to (N+1)).

FIG. 4 is a circuit diagram showing a shift register 31*n* of FIG. 3, wherein n is a positive integer ranging from 1 to (N+1). As shown in FIG. 3 and FIG. 4 and compared with the gate drivers 12*y* (y=1 to P) of FIG. 1, the amorphous silicon gate driver 300 does not have the function of an off-controlling signal XAO (i.e., does not have the function of eliminating the residual image after the LCD is turned off). This is because the off-controlling signal XAO is a low-level voltage (about 0 to 3.3 volts) in the conventional LCD 10 and can be received by the shift register (not depicted in the drawing) in the gate drivers 12*y* (y=1 to P). In the amorphous silicon manufacturing process, however, the off-controlling signal XAO is a high-level voltage, which may reach as high as 20 volts, and cannot be received by the shift registers 31*x* (x=1 to (N+1)). So, the problem of the residual image after the LCD is turned off appears again if a gate driving device of the LCD is manufactured by the amorphous silicon manufacturing process.

There is a need for a flat panel display, which can use a gate driving device manufactured by an amorphous silicon manufacturing process and can make all pixel electrodes discharge according to an off-controlling signal to eliminate a residual image when the flat panel display is turned off.

SUMMARY

According to a first aspect of the present invention, a flat panel display including a plurality of pixel electrodes, a first multiplexer, a second multiplexer, a third multiplexer and a gate driver is provided. The first multiplexer is for receiving a high working voltage and a low working voltage and is controlled by an off-controlling signal to output an input low power voltage. The second multiplexer is for receiving the high working voltage and a zeroth clock signal and is controlled by the off-controlling signal to output a zeroth input clock signal. The third multiplexer is for receiving the high working voltage and a first clock signal and is controlled by the off-controlling signal to output a first input clock signal. The gate driver has (N+1) shift registers, wherein N is a positive integer. The gate driver is electrically connected to the pixel electrodes, and the $n^{th}$ shift register includes a SR flip-flop, a first transistor and a second transistor. The SR flip-flop, which has a set terminal, a reset terminal, an output terminal and an inverting output terminal, and is electrically connected to the high working voltage and the low working voltage, wherein the set terminal is coupled to an $(n-1)^{th}$ output signal of the $(n-1)^{th}$ shift register, the reset terminal is coupled to an $(n+1)^{th}$ output signal of the $(n+1)^{th}$ shift register. The first transistor is formed on a glass substrate and has a control terminal coupled to the output terminal and a first terminal for receiving an $M^{th}$ input clock signal, wherein M=1 if n is even and M=0 if n is odd. The second transistor is formed on the glass substrate. The second transistor has a control terminal coupled to the inverting output terminal, a first terminal, which is coupled to a second terminal of the first transistor and outputs an $n^{th}$ output signal, and a second terminal coupled to the input low power voltage, wherein n is a positive integer ranging from 1 to (N+1). When the flat panel display is turned off, the off-controlling signal is transformed from a high-level voltage to a low-level voltage so that the input low power voltage outputted from the first multiplexer is transformed to the high working voltage, the zeroth input clock signal outputted from the second multiplexer is transformed to the high working voltage, the first input clock signal outputted from the third multiplexer is transformed to the high working voltage to make the first transistor or the second transistor turn on, and the $n^{th}$ output signal outputs the high working voltage to make the pixel electrodes discharge.

According to a second aspect of the present invention, a flat panel display having an amorphous silicon gate structure is provided. The flat panel display includes a plurality of pixel electrodes, a first multiplexer, a second multiplexer and a gate driver. The first multiplexer is for receiving a high working voltage and a low working voltage and is controlled by an off-controlling signal to output a power voltage. The second multiplexer is for receiving the low working voltage and an initial voltage and is controlled by the off-controlling signal to output a zeroth trigger signal. The gate driver has the amorphous silicon gate structure and (N+1) shift registers, wherein N is a positive integer. The gate driver is electrically connected to the pixel electrodes. The $n^{th}$ shift register includes a SR flip-flop, a first transistor, a second transistor, a third transistor, a first capacitor, a second capacitor, a fourth transistor and a fifth transistor. The SR flip-flop has a set terminal, a reset terminal, an output terminal and an inverting output terminal and is electrically connected to the high working voltage and the low working voltage. The set terminal is coupled to an $(n-1)^{th}$ trigger signal of the $(n-1)^{th}$ shift register, and the reset terminal is coupled to an $(n+1)^{th}$ output signal of the $(n+1)^{th}$ shift register. The first transistor is formed on a glass substrate and has a control terminal coupled to the output terminal and a first terminal for receiving an $M^{th}$ clock signal, wherein M=1 if n is even and M=0 if n is odd. The second transistor is formed on the glass substrate. The second transistor has a control terminal coupled to the inverting output terminal, a first terminal, which is coupled to a second terminal of the first transistor and outputs an $n^{th}$ output signal, and a second terminal coupled to the power voltage. The third transistor is formed on the glass substrate. The third transistor has a first terminal coupled to the control terminal of the second transistor, and a second terminal coupled to a control terminal of the third transistor and coupled to the power voltage. The first capacitor is coupled to the first terminal of the second transistor and the control terminal of the second transistor. The second capacitor is coupled to the second terminal of the second transistor and the control terminal of the second transistor. The fourth transistor is formed on the glass substrate. The fourth transistor has a control terminal coupled to the output terminal, and a first terminal coupled to the $M^{th}$ clock signal. The fifth transistor is formed on the glass substrate. The fifth transistor has a control terminal coupled to the inverting output terminal, a first terminal, which is coupled to a second terminal of the fourth transistor and outputs an $n^{th}$ trigger signal, and a second terminal coupled to the low working voltage, wherein n is a positive integer ranging from 1 to (N+1). When the flat panel display is turned off, the off-controlling signal is transformed from a high-level voltage to a low-level voltage so that the power voltage outputted from the first multiplexer is transformed to the high working voltage to (i) make the second transistor turn on and output the $n^{th}$ output signal at the high working voltage to make the pixel electrodes discharge and (ii) make the fifth transistor turn on so that the $n^{th}$ trigger signal outputted from the fifth transistor is held on the low-level voltage.

According to a third aspect of the present invention, a flat panel display including many pixel electrodes, a first multiplexer, a second multiplexer and a gate driver is further provided. The first multiplexer is for receiving a high working voltage and a low working voltage and is controlled by an off-controlling signal to output a power voltage. The second multiplexer is for receiving the high working voltage and the low working voltage and is controlled by the off-controlling signal to output a switch voltage. The gate driver has (N+1) shift registers, wherein N is a positive integer. The gate driver is electrically connected to the pixel electrodes. The $n^{th}$ shift register includes a SR flip-flop, a first transistor, a second transistor, a third transistor, a first capacitor, a second capacitor, a fourth transistor and a fifth transistor. The SR flip-flop has a set terminal, a reset terminal, an output terminal and an inverting output terminal and is electrically connected to the high working voltage and the low working voltage. The reset terminal is coupled to an $(n+1)^{th}$ output signal of the $(n+1)^{th}$ shift register. The first transistor formed on a glass substrate has a control terminal coupled to the output terminal, and a first terminal for receiving an $M^{th}$ clock signal, wherein M=1 if n is even and M=0 if n is odd. The second transistor formed on the glass substrate has a control terminal coupled to the inverting output terminal, a first terminal, which is coupled to a second terminal of the first transistor and outputs an $n^{th}$ output signal, and a second terminal coupled to the power voltage. The third transistor formed on the glass substrate has a first terminal coupled to the control terminal of the second transistor, and a second terminal coupled to a control terminal of the third transistor and coupled to the power voltage. The first capacitor is coupled to the first terminal of the second transistor and the control terminal of the second transistor. The second capacitor is coupled to the second terminal of the second transistor and the control terminal of the second transistor. The fourth transistor formed on the has a control terminal coupled to the switch voltage, a first terminal coupled to the set terminal, and a second terminal coupled to an $(n-1)^{th}$ output signal of the $(n-1)^{th}$ shift register. The fifth transistor formed on the glass substrate has a control terminal coupled to the power voltage, a first terminal coupled to the first terminal of the fourth transistor, and a second terminal electrically connected to the low working voltage, wherein n is a positive integer ranging from 1 to (N+1). When the flat panel display is turned off, the off-controlling signal is transformed from a high-level voltage to a low-level voltage so that the power voltage outputted from the first multiplexer is transformed to the high working voltage and the switch voltage outputted from the second multiplexer is transformed to the low working voltage to make the second transistor turn on, and the $n^{th}$ output signal outputs the high working voltage to make the pixel electrodes discharge.

According to a fourth aspect of the present invention, a gate driving device for driving a plurality of pixel electrodes is provided. The gate driving device and the pixel electrodes are formed on a glass substrate. The gate driving device includes a displacement temporary storage unit, which comprises a plurality of shift registers each comprising a power supply source and a clock terminal. One of a first voltage and a second voltage is selected and transmitted to the power supply source, and one of the first voltage and a clock signal is selected and transmitted to the clock terminal according to an off-controlling signal for causing the pixel electrodes connected to said shift registers to discharge.

Additional aspects and advantages of embodiments of the present invention are set forth in part in the description which follows, and in part are apparent from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE DRAWINGS

The disclosed embodiments are illustrated by way of example, and not by limitation, in the figures of the accompanying drawings, wherein elements having the same reference numeral designations represent like elements throughout.

DETAILED DESCRIPTION OF THE INVENTION

Figure 1:
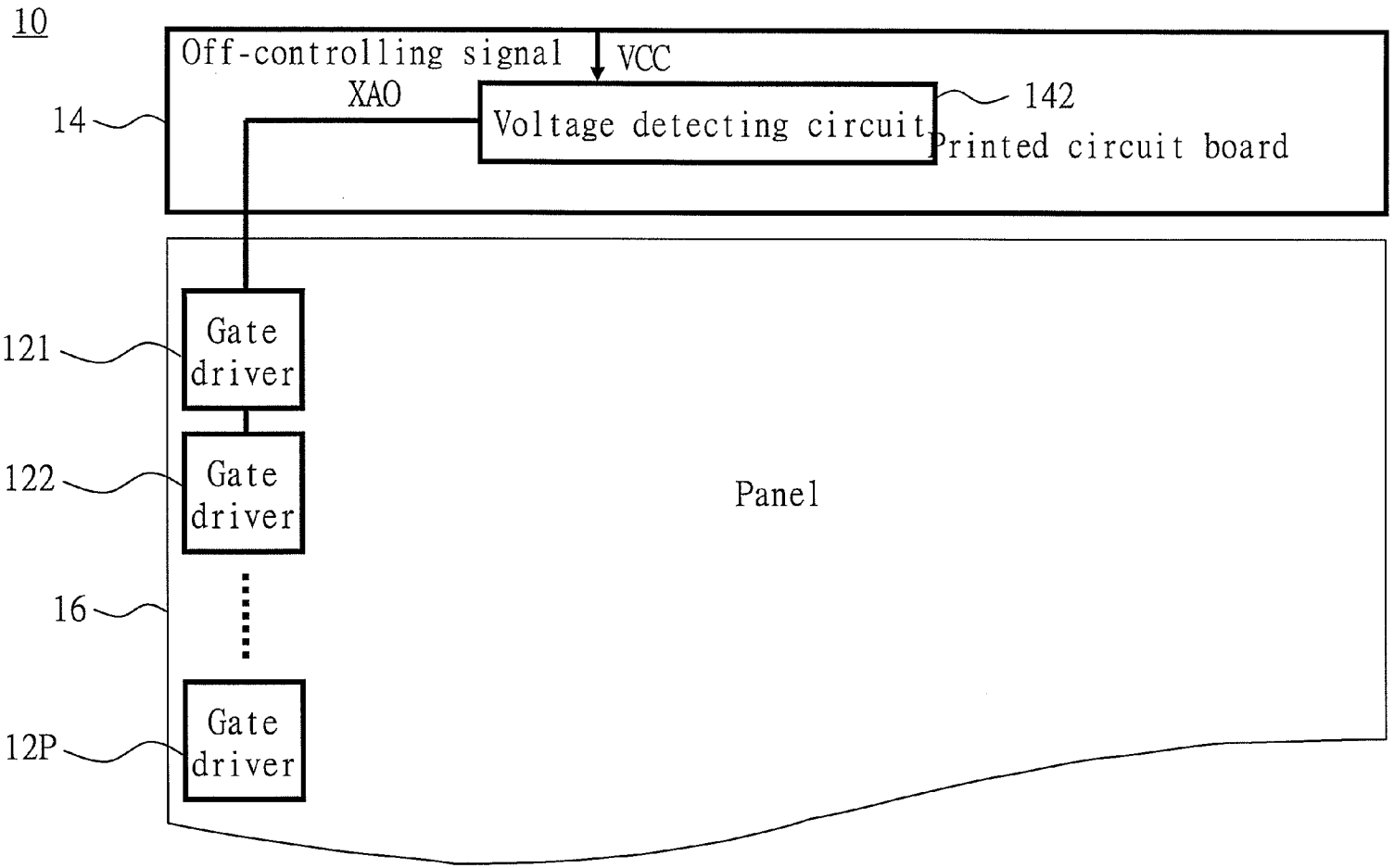
FIG. 1(PRIOR ART)
FIG. 1 is a schematic illustration showing a conventional LCD.
Figure 2:
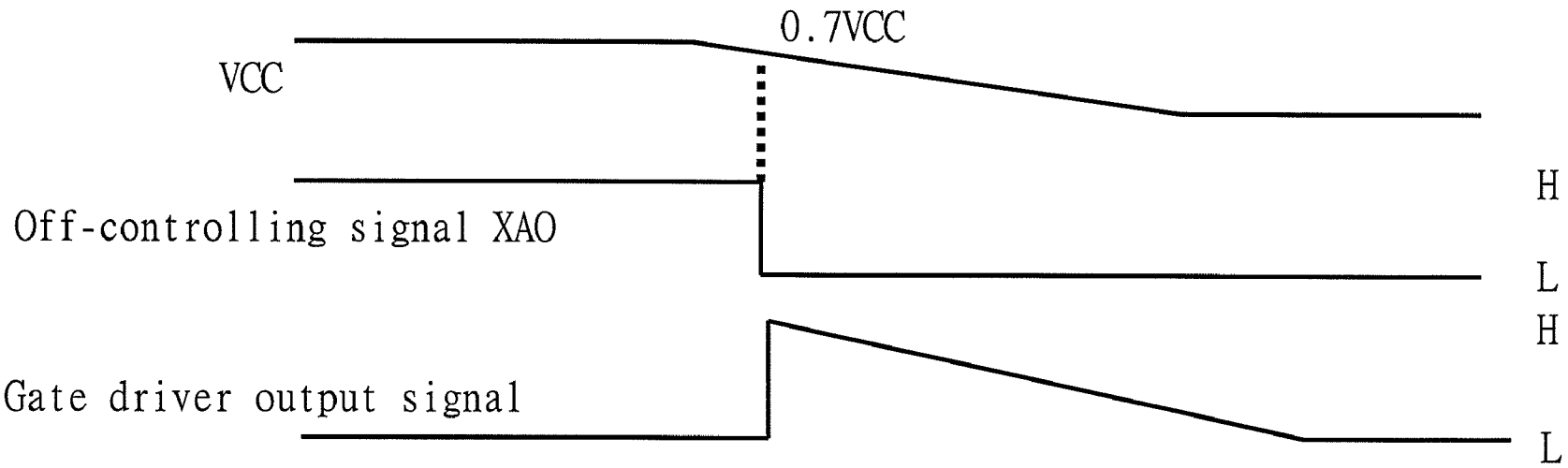
FIG. 2(PRIOR ART)
FIG. 2 shows signal waveforms in the LCD 10 of FIG. 1.
Figure 3:
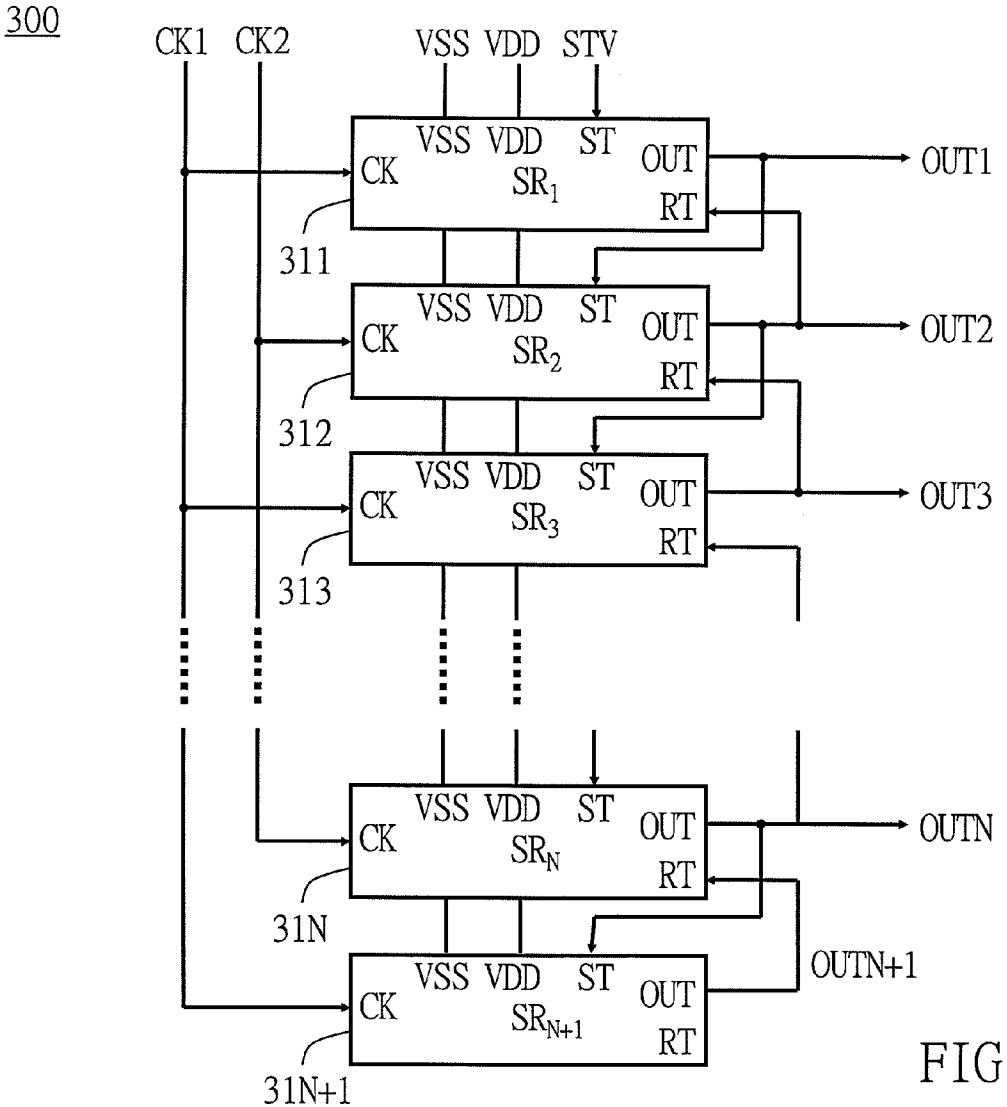
FIG. 3 is a block diagram showing an amorphous silicon gate driver.
Figure 4:
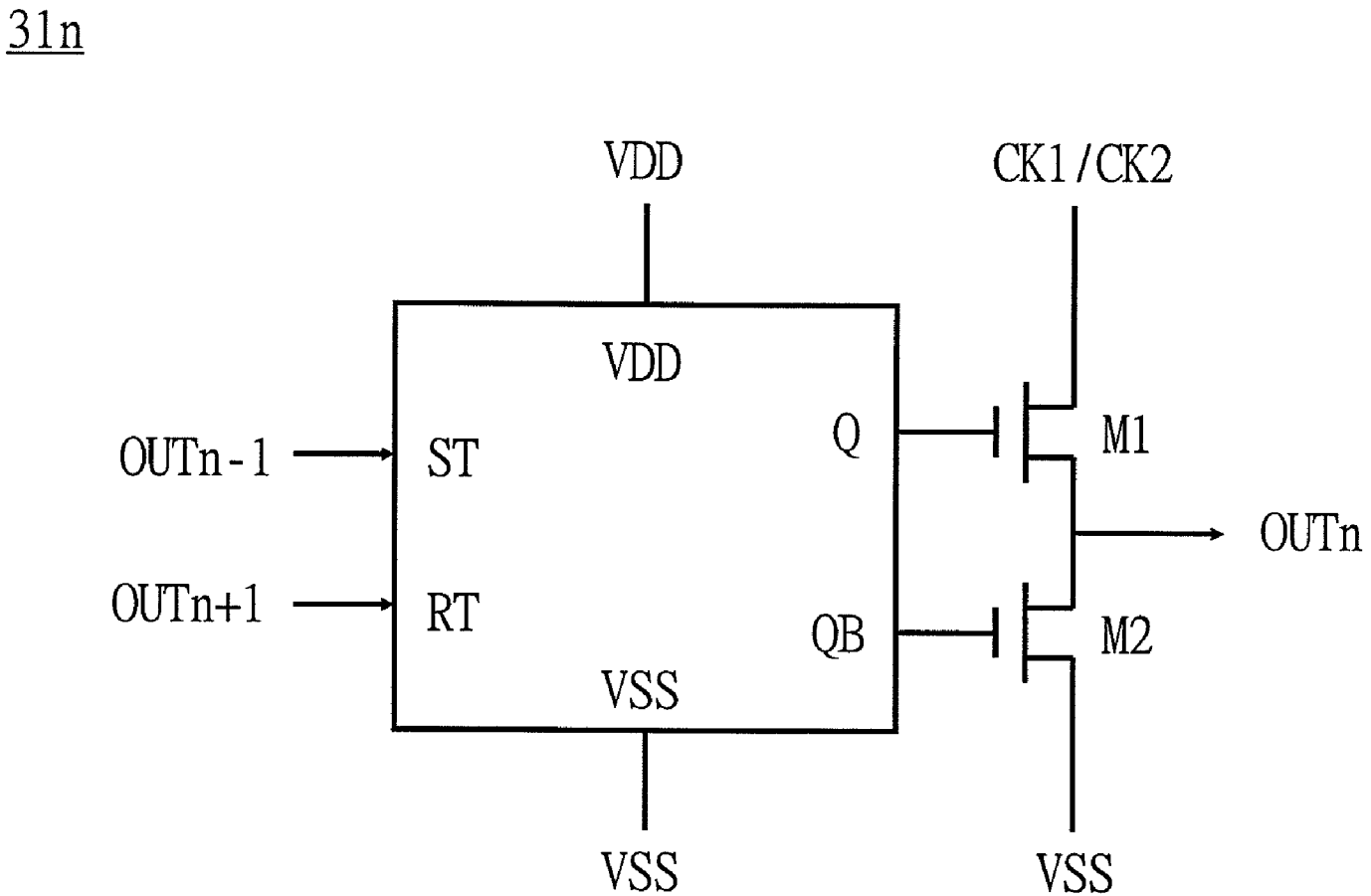
FIG. 4 is a circuit diagram showing a shift register 31*n* of FIG. 3.
Figure 5:
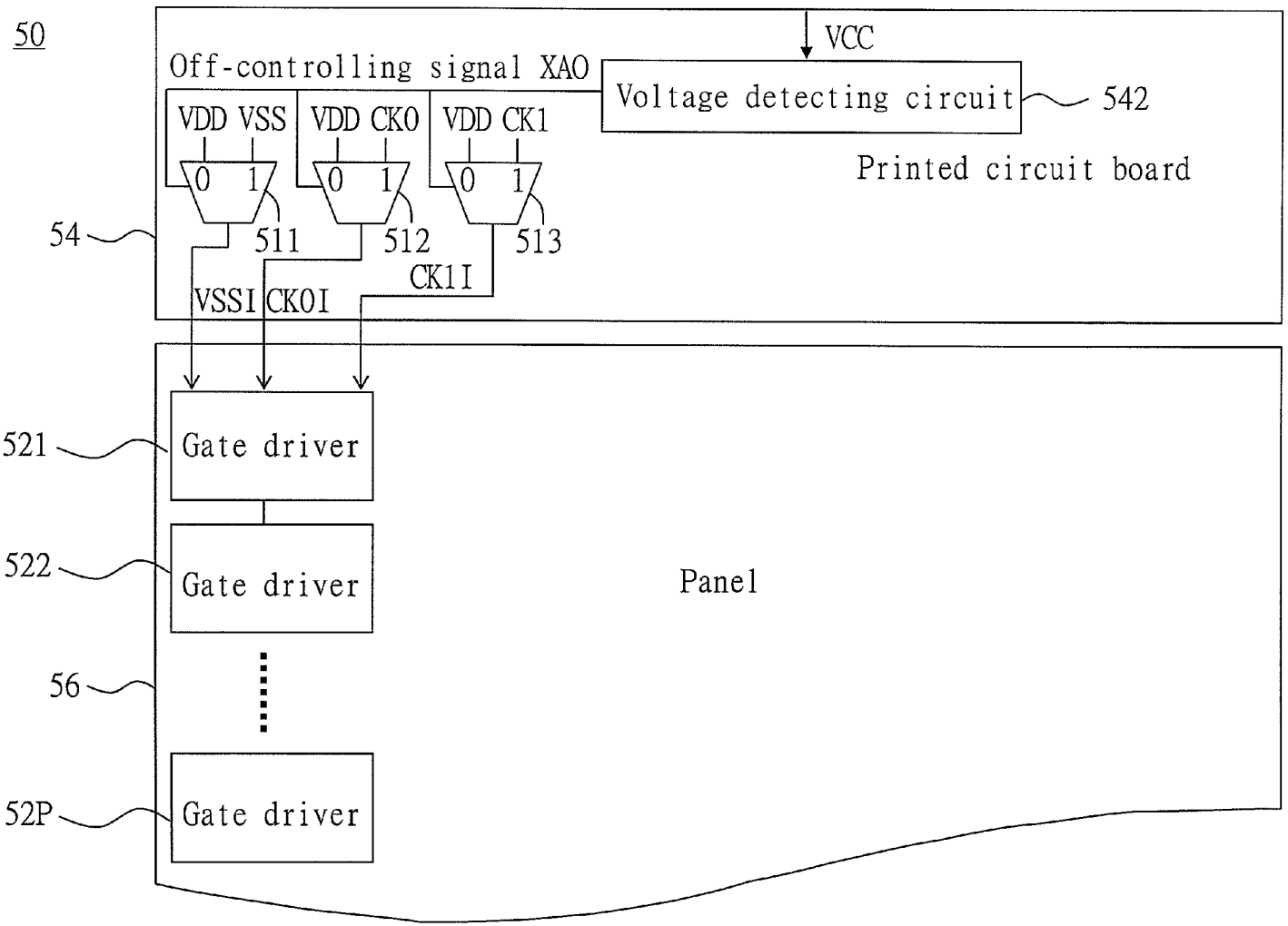
FIG. 5 is a schematic illustration showing a flat panel display according to a first embodiment of the invention.

FIG. 5 is a schematic illustration showing a flat panel display 50 according to a first embodiment of the invention. Referring to FIG. 5, the flat panel display 50 includes a plurality of pixel electrodes (not depicted) disposed on a panel 56, a first multiplexer 511, a second multiplexer 512, a third multiplexer 513, and gate drivers 52*y* (y=1 to P). The flat panel display 50 further includes a printed circuit board 54, which has a voltage detecting circuit 542 for detecting a variation of an operation voltage VCC, and thus outputting an off-controlling signal XAO. For example, when the flat panel display 50 is turned off, the voltage detecting circuit 542 outputs the off-controlling signal XAO as a low-level voltage L when the operation voltage VCC is lowered, e.g., by 30%.

Figure 6:
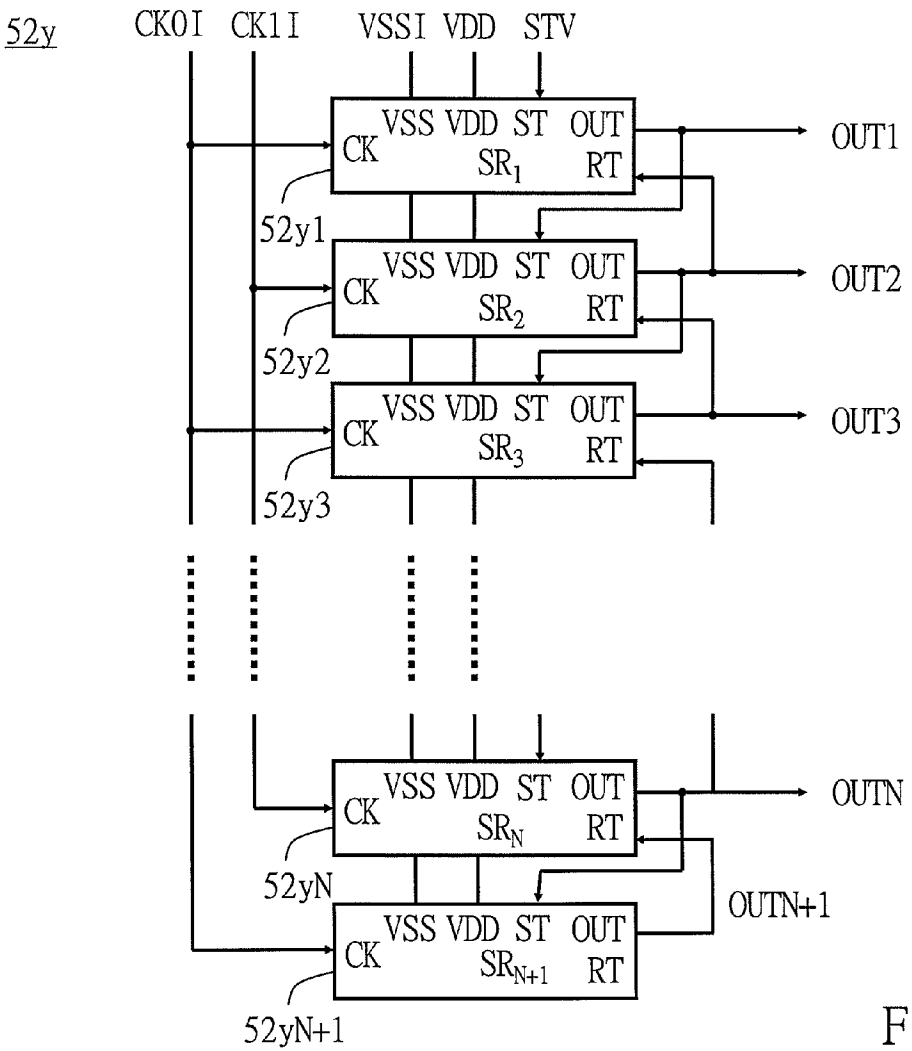
FIG. 6 is a block diagram showing a gate driver 52*y* in FIG. 5.

In the flat panel display 50, the first multiplexer 511 is for receiving a high working voltage VDD and a low working voltage VSS, and is controlled by the off-controlling signal XAO to output an input low power voltage VSSI. The second multiplexer 512 is for receiving the high working voltage VDD and a zeroth clock signal CK0 and is controlled by the off-controlling signal XAO to output a zeroth input clock signal CK0I. The third multiplexer 513 is for receiving the high working voltage VDD and a first clock signal CK1 and is controlled by the off-controlling signal XAO to output a first input clock signal CK1I. FIG. 6 is a block diagram showing a gate driver 52*y* in FIG. 5. As shown in FIG. 6, each of the gate drivers 52*y* (y=1 to P) is an amorphous silicon gate driver and has transistors formed on a glass substrate to save the cost. The gate drivers 52*y* (y=1 to P) have (N+1) shift registers 52*yx* (x=1 to (N+1)), wherein N is a positive integer. The gate drivers 52*y* (y=1 to P) are respectively electrically connected to the pixel electrodes. In FIG. 6, STV is a control signal received from a timing controller (not shown) to trigger a start pulse to activate the first stage of the shift registers.

Figure 7:
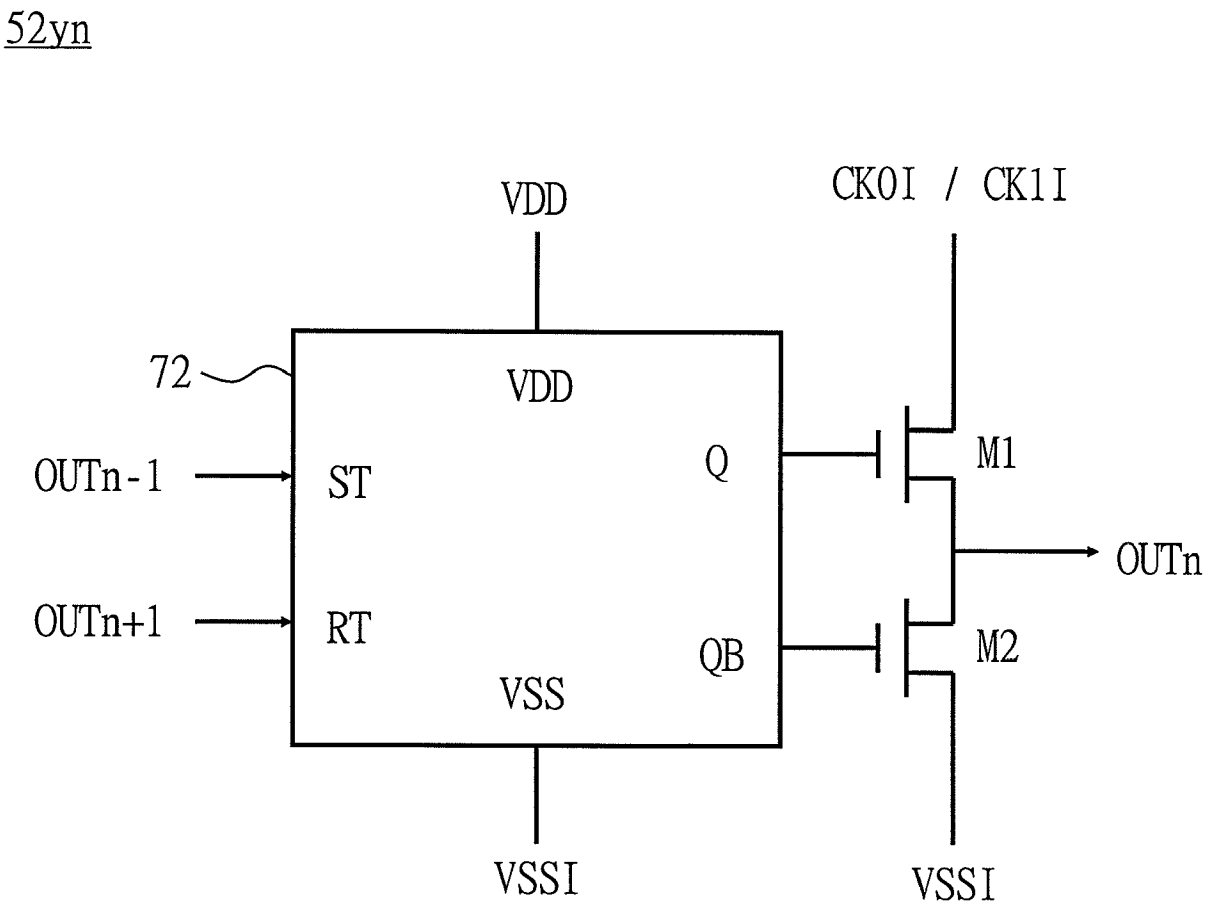
FIG. 7 is a circuit diagram showing a shift register 52*yn* in FIG. 6.

FIG. 7 is a circuit diagram showing a shift register 52*yn* in FIG. 6. Referring to FIG. 7, the shift register 52*yn* includes a SR flip-flop 72, a first transistor M1 and a second transistor M2, wherein n is a positive integer ranging from 1 to (N+1). The SR flip-flop 72 has a set terminal ST, a reset terminal RT, an output terminal Q and an inverting output terminal QB, and is electrically connected to the high working voltage VDD and the low working voltage VSSI. The set terminal ST is coupled to an $(n-1)^{th}$ output signal OUTn−1 of the $(n-1)^{th}$ shift register, and the reset terminal RT is coupled to an $(n+1)^{th}$ output signal OUTn+1 of the $(n+1)^{th}$ shift register.

The first transistor M1 formed on the glass substrate has a control terminal coupled to the output terminal Q, and a first terminal for receiving an $M^{th}$ input clock signal, wherein M=1 if n is even and M=0 if n is odd. That is, when the shift register 52*yn* is sorted as an odd-numbered shift register, it receives the zeroth input clock signal CK0I; and when the shift register 52*yn* is sorted as an even-numbered shift register, it receives the first input clock signal CK1I. The second transistor M2 formed on the glass substrate has a control terminal coupled to the inverting output terminal QB, a first terminal, which is coupled to a second terminal of the first transistor M1 and outputs an $n^{th}$ output signal OUTn, and a second terminal coupled to the input low power voltage VSSI.

Figure 8:
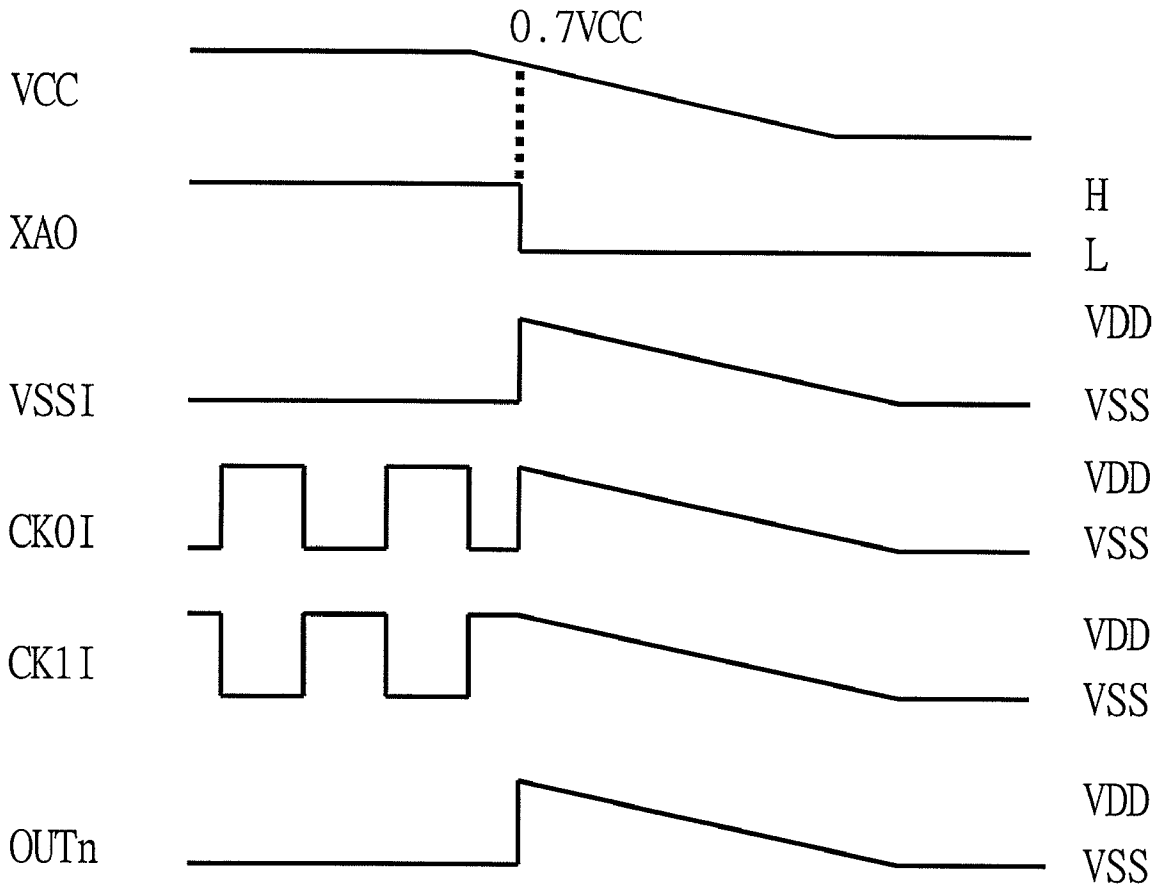
FIG. 8 is a timing chart showing timings of signals in the shift register 52*yn* of FIG. 7.

FIG. 8 is a timing chart showing timings of signals in the shift register 52*yn* of FIG. 7. As shown in FIG. 8, when the flat panel display 50 is turned off (i.e., the operation voltage VCC is lowered, e.g., by 30%), the off-controlling signal XAO is transformed from a high-level voltage H to the low-level voltage L so that the input low power voltage VSSI outputted from the first multiplexer 511 is transformed to the high working voltage VDD, the zeroth input clock signal CK0I outputted from the second multiplexer 512 is transformed to the high working voltage VDD, and the first input clock signal CK1I outputted from the third multiplexer 513 is transformed to the high working voltage VDD to make one of the first transistor M1 and the second transistor M2 turn on, and the $n^{th}$ output signal OUTn outputs the high working voltage VDD to make the pixel electrodes discharge. Thus, the residual image after the LCD is turned off may be eliminated.

Figure 9:
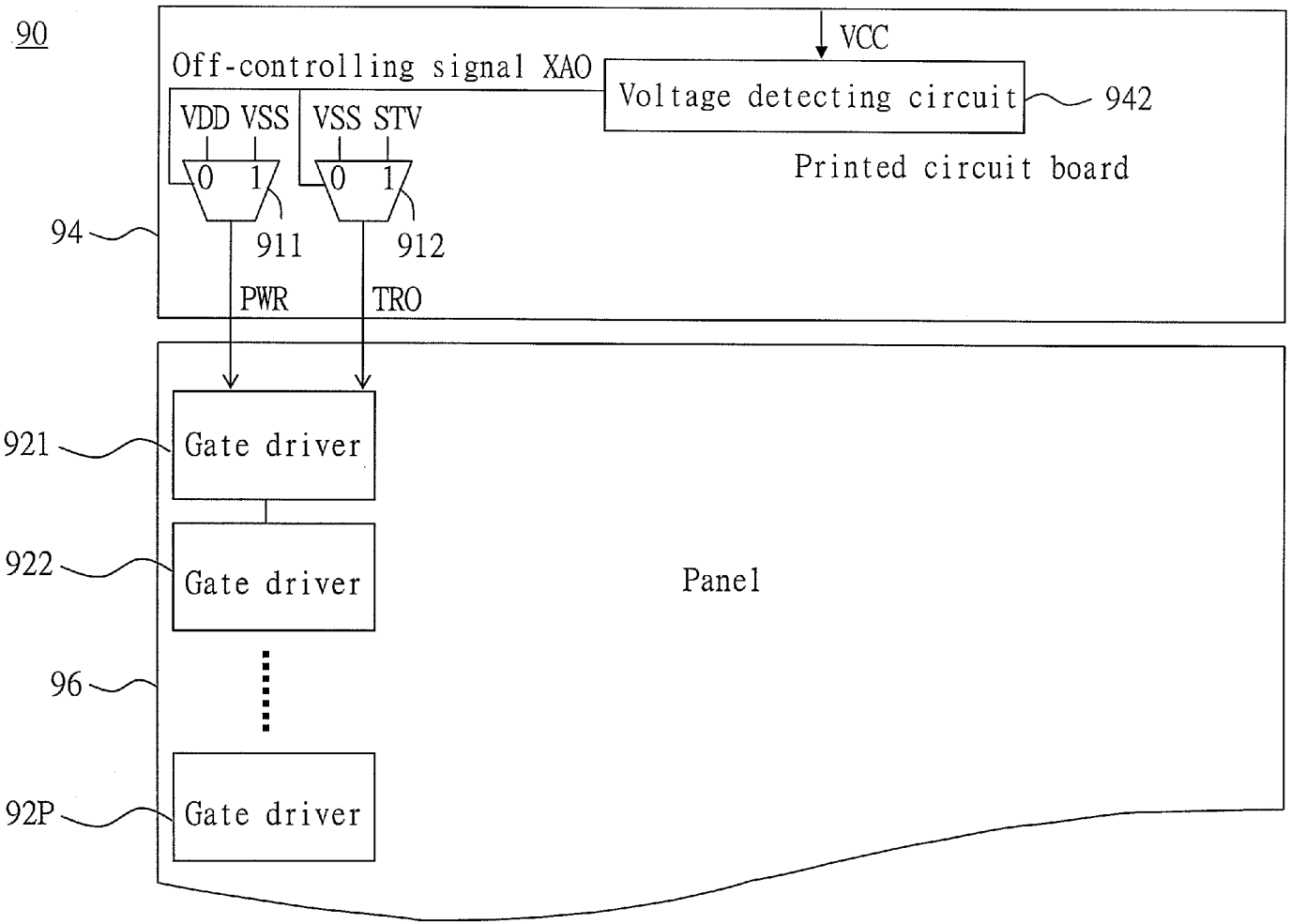
FIG. 9 is a schematic illustration showing a flat panel display according to a second embodiment of the invention.

FIG. 9 is a schematic illustration showing a flat panel display 90 according to a second embodiment of the invention. Referring to FIG. 9, the flat panel display 90 includes a plurality of pixel electrodes (not depicted) disposed on a panel 96, a first multiplexer 911, a second multiplexer 912 and gate drivers 92*y* (y=1 to P). The flat panel display 90 further includes a printed circuit board 94, which has a voltage detecting circuit 942 for detecting the variation of the operation voltage VCC and thus outputting the off-controlling signal XAO. For example, when the flat panel display 90 is turned off, the voltage detecting circuit 942 outputs the off-controlling signal XAO as the low-level voltage L when the operation voltage VCC is lowered, e.g., by 30%.

Figure 10:
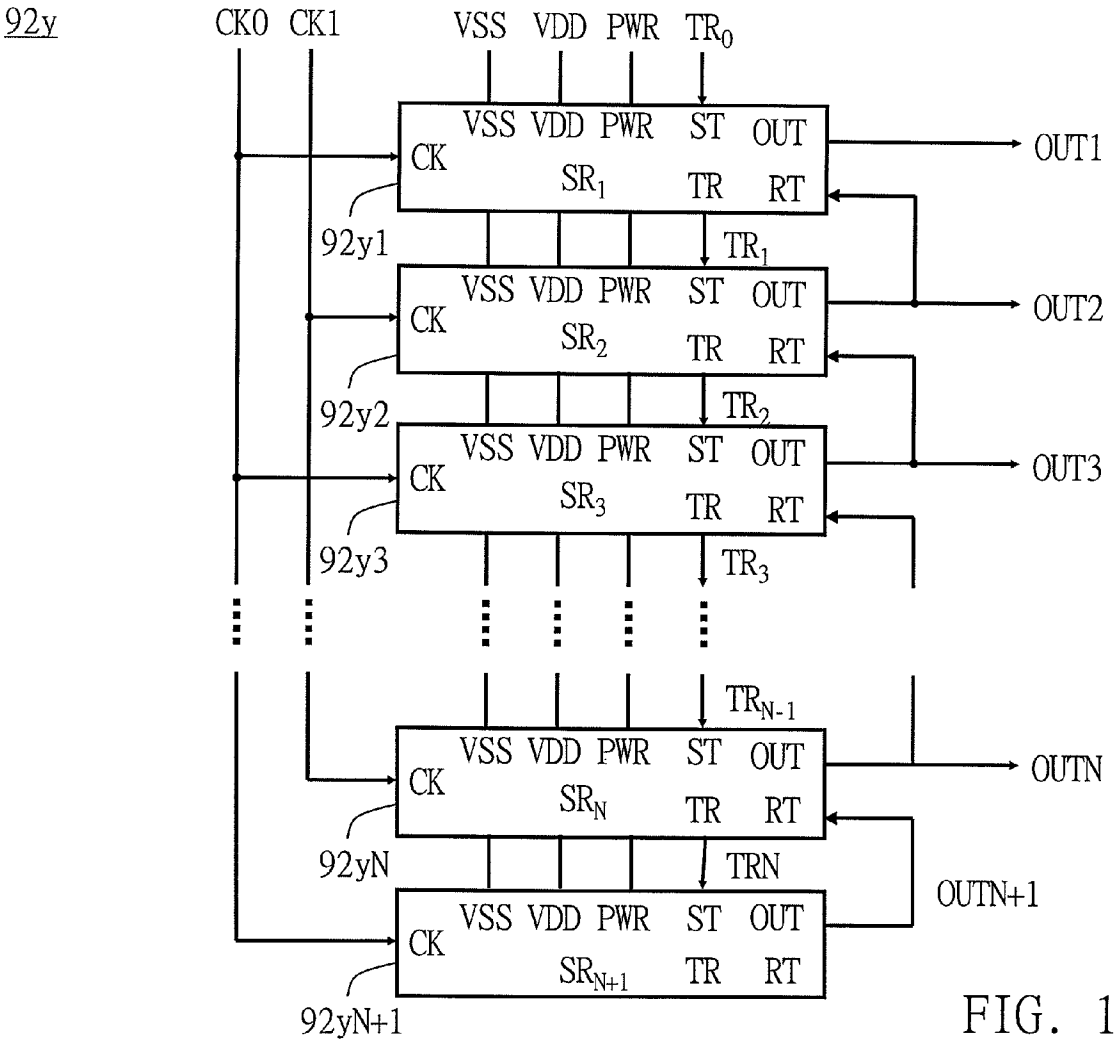
FIG. 10 is a block diagram showing a gate driver 92*y* in FIG. 9.

In the flat panel display 90, the first multiplexer 911 is for receiving the high working voltage VDD and the low working voltage VSS, and is controlled by the off-controlling signal XAO to output a power voltage PWR. The second multiplexer 912 is for receiving the low working voltage VSS and an initial voltage STV, and is controlled by the off-controlling signal XAO to output a zeroth trigger signal TR0. FIG. 10 is a block diagram showing a gate driver 92*y* in FIG. 9. As shown in FIG. 10, each of the gate drivers 92*y* (y=1 to P) is the amorphous silicon gate driver, and has a transistor formed on the glass substrate to save the cost. The gate drivers 92*y* (y=1 to P) have (N+1) shift registers 92$yx$ (x=1 to N), wherein N is a positive integer, and the gate drivers 92$y$ (y=1 to P) are respectively electrically connected to the pixel electrodes.

Figure 11:
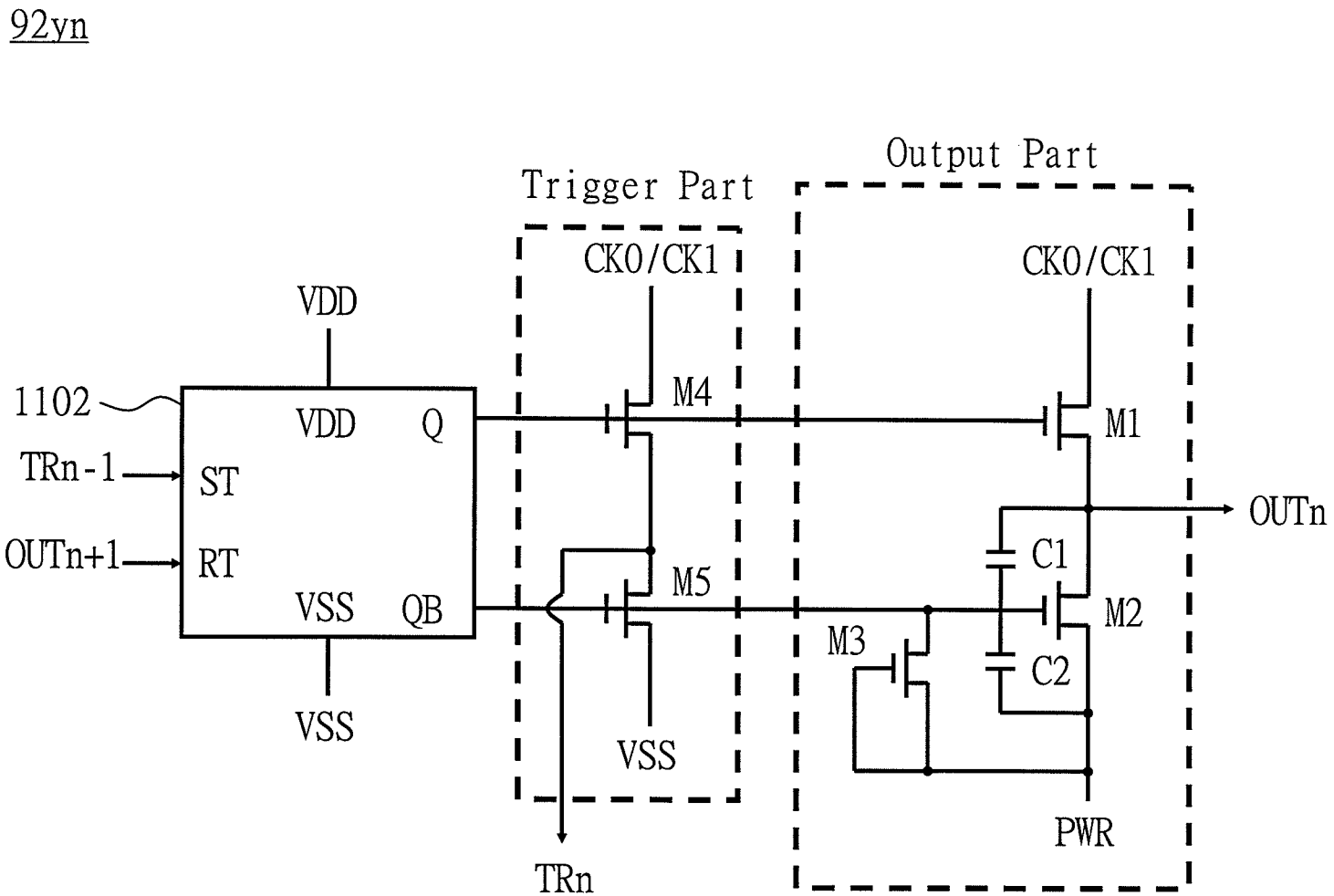
FIG. 11 is a circuit diagram showing a shift register 92*yn* in FIG. 10.

FIG. 11 is a circuit diagram showing a shift register 92$yn$ in FIG. 10. Referring to FIG. 11, the shift register 92$yn$ includes a SR flip-flop 1102, a first transistor M1, a second transistor M2, a third transistor M3, a fourth transistor M4 and a fifth transistor M5, wherein n is a positive integer ranging from 1 to (N+1). The SR flip-flop 1102 has a set terminal ST, a reset terminal RT, an output terminal Q and an inverting output terminal QB, and is electrically connected to the high working voltage VDD and the low working voltage VSS. The set terminal ST is coupled to an $(n-1)^{th}$ trigger signal TRn−1 of the $(n-1)^{th}$ shift register, and the reset terminal RT is coupled to an $(n+1)^{th}$ output signal OUTn+1 of the $(n+1)^{th}$ shift register.

The first transistor M1 formed on the glass substrate has a control terminal coupled to the output terminal Q, and a first terminal for receiving an $M^{th}$ clock signal, wherein M=1 if n is even and M=0 if n is odd. That is, when the shift register 52$yn$ is sorted as an odd-numbered shift register, it receives the zeroth clock signal CK0; and when the shift register 52$yn$ is sorted as an even-numbered shift register, it receives the first clock signal CK1. The second transistor M2 formed on the glass substrate has a control terminal coupled to the inverting output terminal QB, a first terminal, which is coupled to a second terminal of the first transistor M1 and outputs an $n^{th}$ output signal OUTn, and a second terminal coupled to the power voltage PWR. The third transistor M3 formed on the glass substrate has a first terminal coupled to the control terminal of the second transistor M2, and a second terminal coupled to a control terminal of the third transistor M3 and coupled to the power voltage PWR. The third transistor M3 substantially serves as a diode.

A first capacitor C1 is coupled to the first terminal of the second transistor M2 and the control terminal of the second transistor M2. A second capacitor C2 is coupled to the second terminal of the second transistor M2 and the control terminal of the second transistor M2. The first capacitor C1 and the second capacitor C2 respectively hold constant level voltages with opposite phases. The fourth transistor M4 formed on the glass substrate has a control terminal coupled to the output terminal Q, and a first terminal coupled to the $M^{th}$ clock signal. The fifth transistor M5 formed on the glass substrate has a control terminal coupled to the inverting output terminal QB, a first terminal, which is coupled to a second terminal of the fourth transistor M4 and outputs an $n^{th}$ trigger signal TRn, and a second terminal coupled to the low working voltage VSS. The fourth transistor M4 and the fifth transistor M5 substantially serve as a trigger circuit for triggering a next stage of shift register 92$yn$+1.

Figure 12:
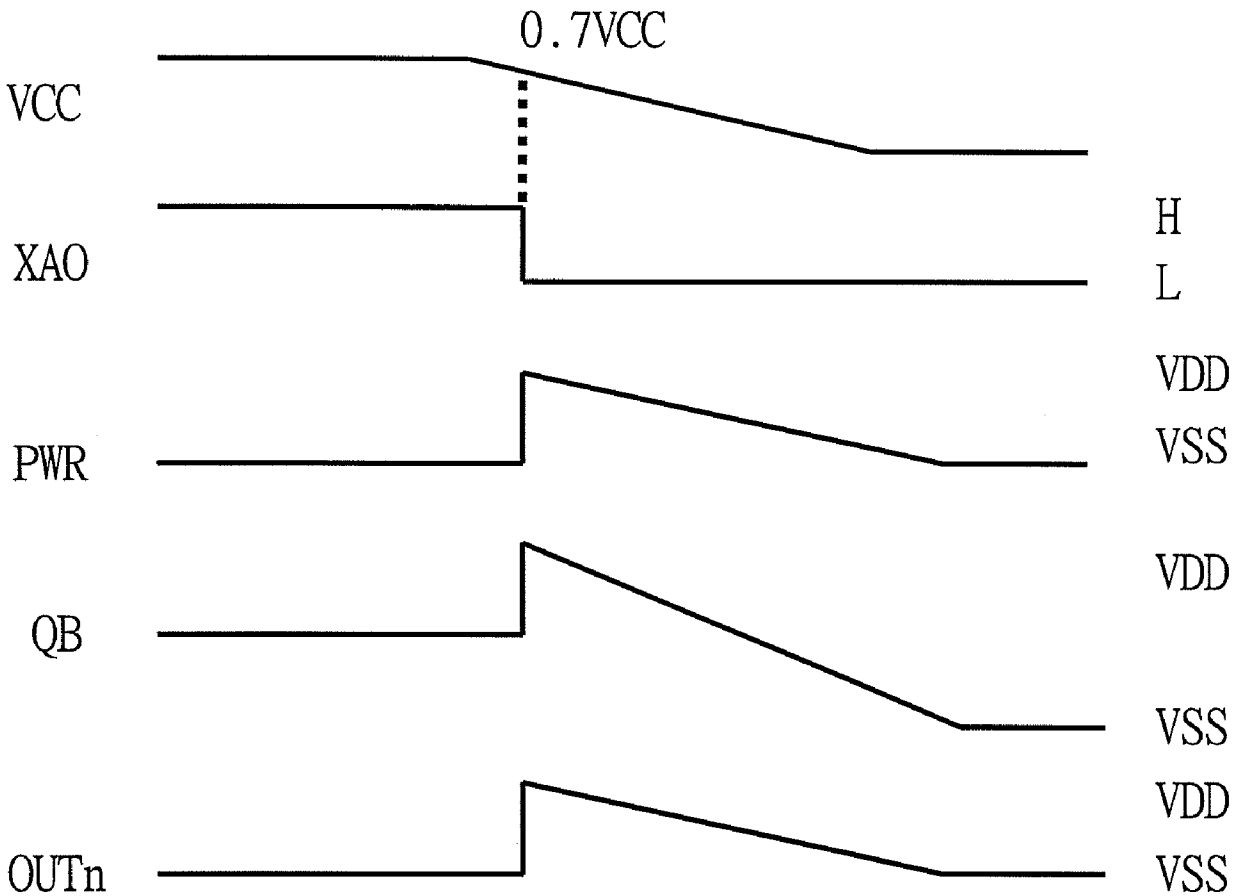
FIG. 12 is a timing chart showing timings of signals in the shift register 92*yn* of FIG. 11.

FIG. 12 is a timing chart showing timings of signals in the shift register 92$yn$ of FIG. 11. As shown in FIG. 12, when the flat panel display 90 is turned off (i.e., the operation voltage VCC is lowered, e.g., by 30%), the off-controlling signal XAO is transformed from the high-level voltage H to the low-level voltage L so that the power voltage PWR outputted from the first multiplexer 911 is transformed to the high working voltage VDD and the zeroth trigger signal TR0 (TR0 is shown in FIG. 9) outputted from the second multiplexer 912 is transformed to the low working voltage VSS to make the second transistor M2 of the shift register 92$yn$ turn on, and the $n^{th}$ output signal OUTn outputs the high working voltage VDD to make the pixel electrodes discharge. Thus, the residual image after the LCD is turned off may be eliminated.

In addition, when the flat panel display 90 is turned off, the power voltage PWR outputted from the first multiplexer 911 is transformed to the high working voltage VDD to make the fifth transistor M5 turn on so that the $n^{th}$ trigger signal TRn outputted from the fifth transistor is held on the low-level voltage L as the input for the next stage of shift register 92$yn$+1. Thus, the inverting output terminal QB of the shift register 92$yn$+1 holds the output of the high working voltage VDD.

Figure 13:
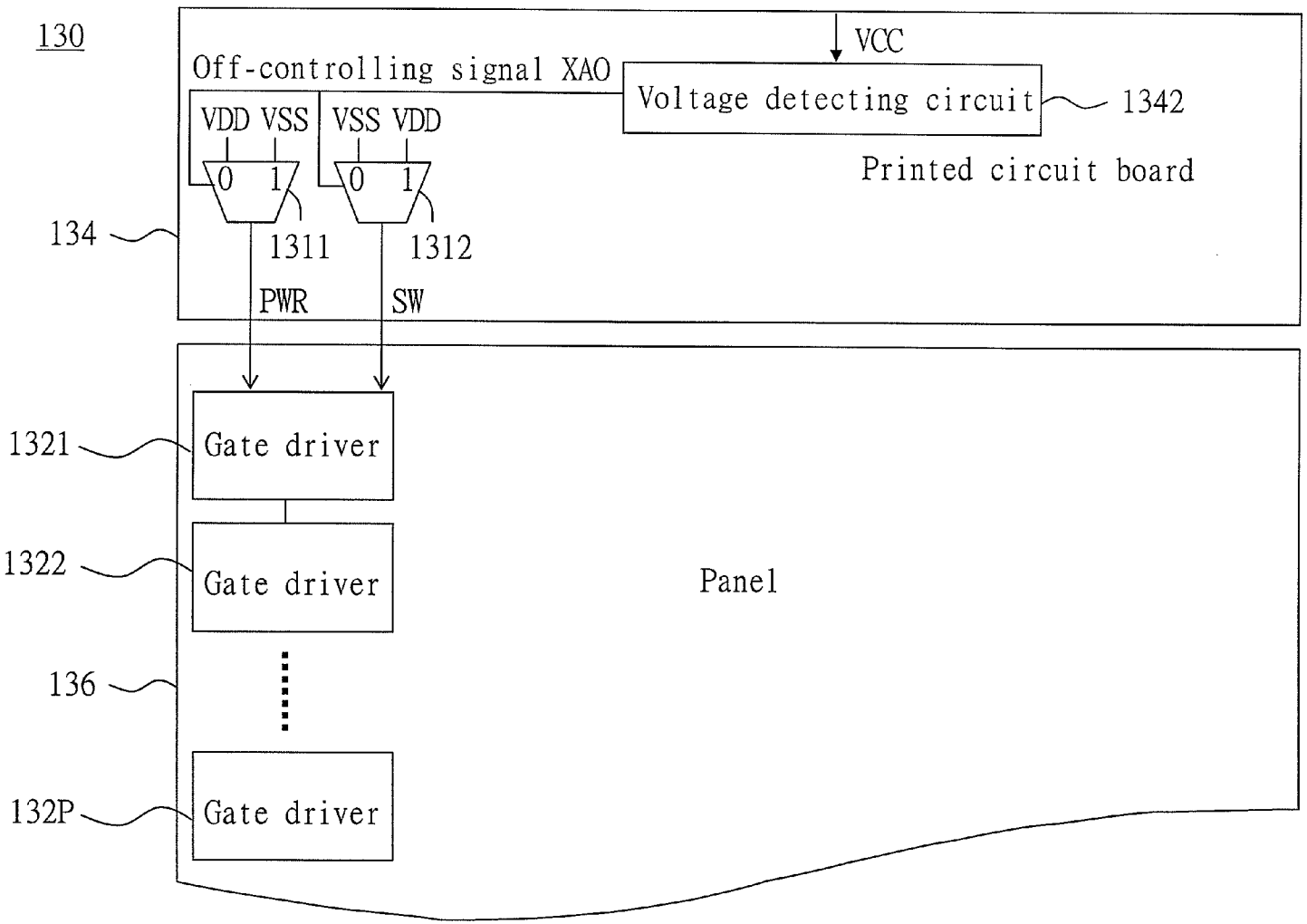
FIG. 13 is a schematic illustration showing a flat panel display according to a third embodiment of the invention.

FIG. 13 is a schematic illustration showing a flat panel display 130 according to a third embodiment of the invention. Referring to FIG. 13, the flat panel display 130 includes a plurality of pixel electrodes (not depicted) disposed on a panel 136, a first multiplexer 1311, a second multiplexer 1312 and gate drivers 132$y$ (y=1 to P). The flat panel display 130 further includes a printed circuit board 134, which has a voltage detecting circuit 1342 for detecting the variation of the operation voltage VCC and thus outputting the off-controlling signal XAO. For example, when the flat panel display 130 is turned off, the voltage detecting circuit 1342 outputs the off-controlling signal XAO as the low-level voltage L when the operation voltage VCC is lowered, e.g., by 30%.

Figure 14:
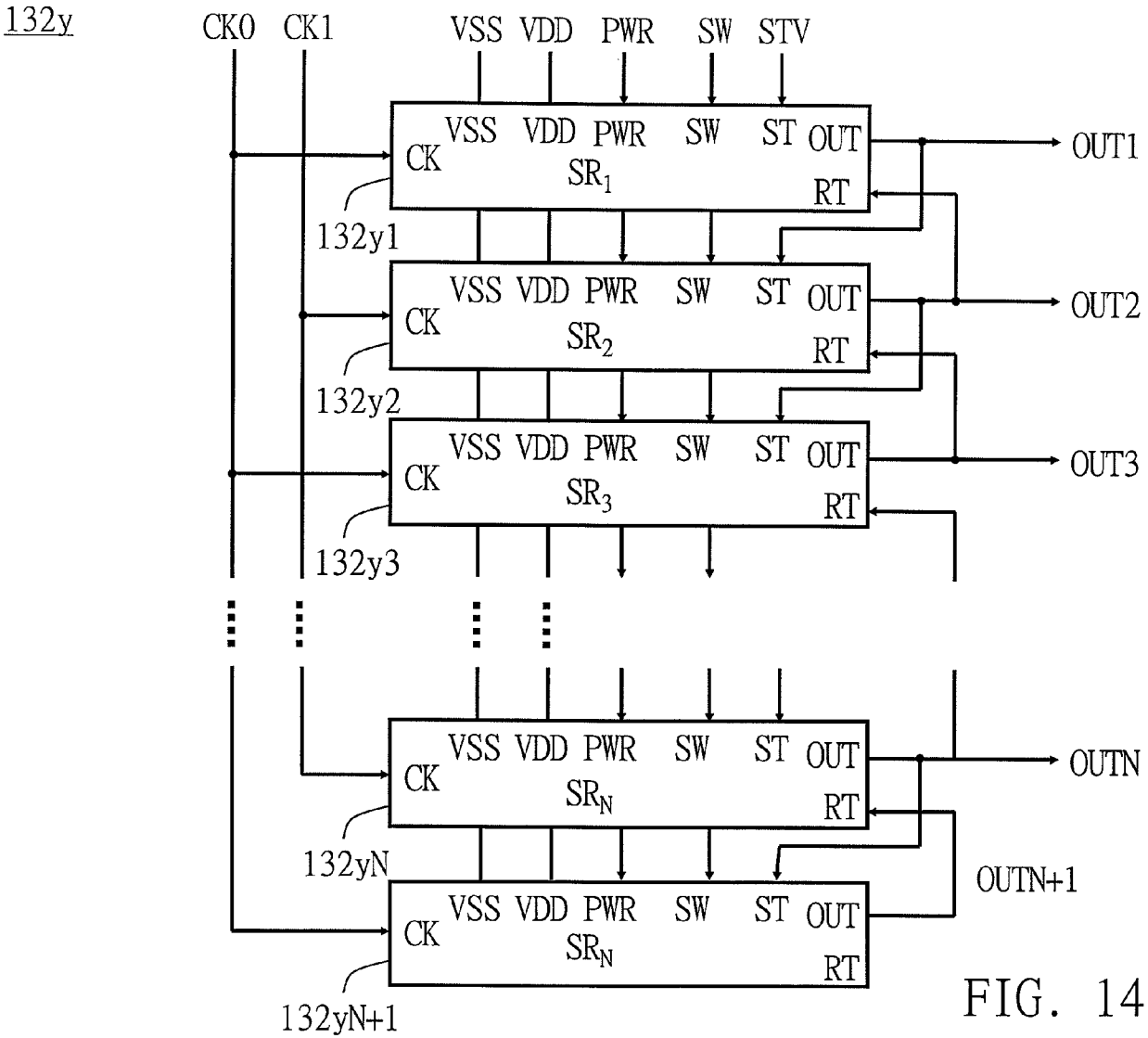
FIG. 14 is a block diagram showing a gate driver 132*y* in FIG. 13.

In the flat panel display 130, the first multiplexer 1311 is for receiving the high working voltage VDD and the low working voltage VSS and is controlled by the off-controlling signal XAO to output a power voltage PWR. The second multiplexer 1312 is for receiving the low working voltage VSS and the high working voltage VDD and is controlled by the off-controlling signal XAO to output a switch voltage SW. FIG. 14 is a block diagram showing a gate driver 132$y$ in FIG. 13. As shown in FIG. 14, each of the gate drivers 132$y$ (y=1 to P) is the amorphous silicon gate driver and has transistors formed on the glass substrate to save the cost. The gate drivers 132$y$ (y=1 to P) have (N+1) shift registers 132$yx$ (x=1 to (N+1)), wherein N is a positive integer, and the gate drivers 132$y$ (y=1 to P) are respectively electrically connected to the pixel electrodes.

Figure 15:
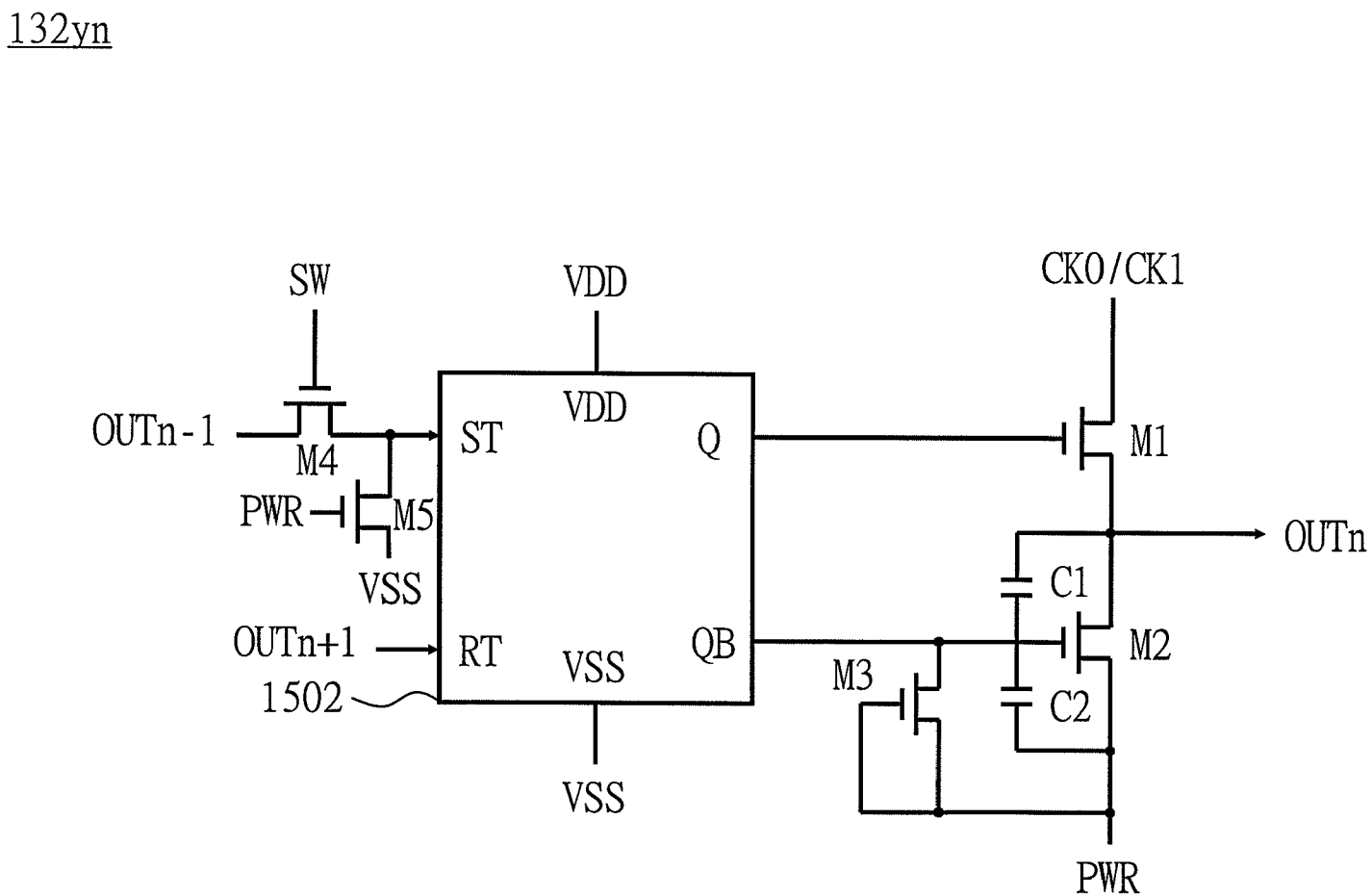
FIG. 15 is a circuit diagram showing a shift register 132*yn* in FIG. 14.

FIG. 15 is a circuit diagram showing a shift register 132$yn$ in FIG. 14. Referring to FIG. 15, the shift register 132$yn$ includes a SR flip-flop 1502, a first transistor M1, a second transistor M2, a third transistor M3, a first capacitor C1, a second capacitor C2, a fourth transistor M4 and a fifth transistor M5, wherein n is a positive integer ranging from 1 to (N+1). The SR flip-flop 1502 has a set terminal ST, a reset terminal RT, an output terminal Q and an inverting output terminal QB, and is electrically connected to the high working voltage VDD and the low working voltage VSS. The reset terminal RT is coupled to the $(n+1)^{th}$ output signal OUTn+1 of the $(n+1)^{th}$ shift register.

The first transistor M1 formed on the glass substrate has a control terminal coupled to the output terminal Q, and a first terminal for receiving an $M^{th}$ clock signal, wherein M=1 if n is even and M=0 if n is odd. That is, when the shift register 132$yn$ is sorted as an odd-numbered shift register, it receives the zeroth clock signal CK0; and when the shift register 132$yn$ is sorted as an even-numbered shift register, it receives the first clock signal CK1. The second transistor M2 formed on the glass substrate has a control terminal coupled to the inverting output terminal QB, a first terminal, which is coupled to a second terminal of the first transistor M1 and outputs an $n^{th}$ output signal OUTn, and a second terminal coupled to the power voltage PWR.

The third transistor M3 formed on the glass substrate has a first terminal coupled to the control terminal of the second transistor M2, and a second terminal coupled to a control terminal of the third transistor M3 and coupled to the power voltage PWR. The third transistor M3 substantially serves as a diode. The first capacitor C1 is coupled to the first terminal of the second transistor M2 and the control terminal of the second transistor M2. The second capacitor C2 is coupled to the second terminal of the second transistor M2 and the control terminal of the second transistor M2. The first capacitor C1 and the second capacitor C2 respectively hold constant level voltages with opposite phases.

The fourth transistor M4 formed on the glass substrate has a control terminal coupled to the switch voltage SW, a first terminal coupled to the set terminal ST, and a second terminal coupled to the $(n-1)^{th}$ output signal OUTn−1 of the $(n-1)^{th}$ shift register. The fifth transistor M5 formed on the glass substrate has a control terminal coupled to the power voltage PWR, a first terminal coupled to the first terminal of the fourth transistor M4, and a second terminal electrically connected to the low working voltage VSS.

Figure 16:
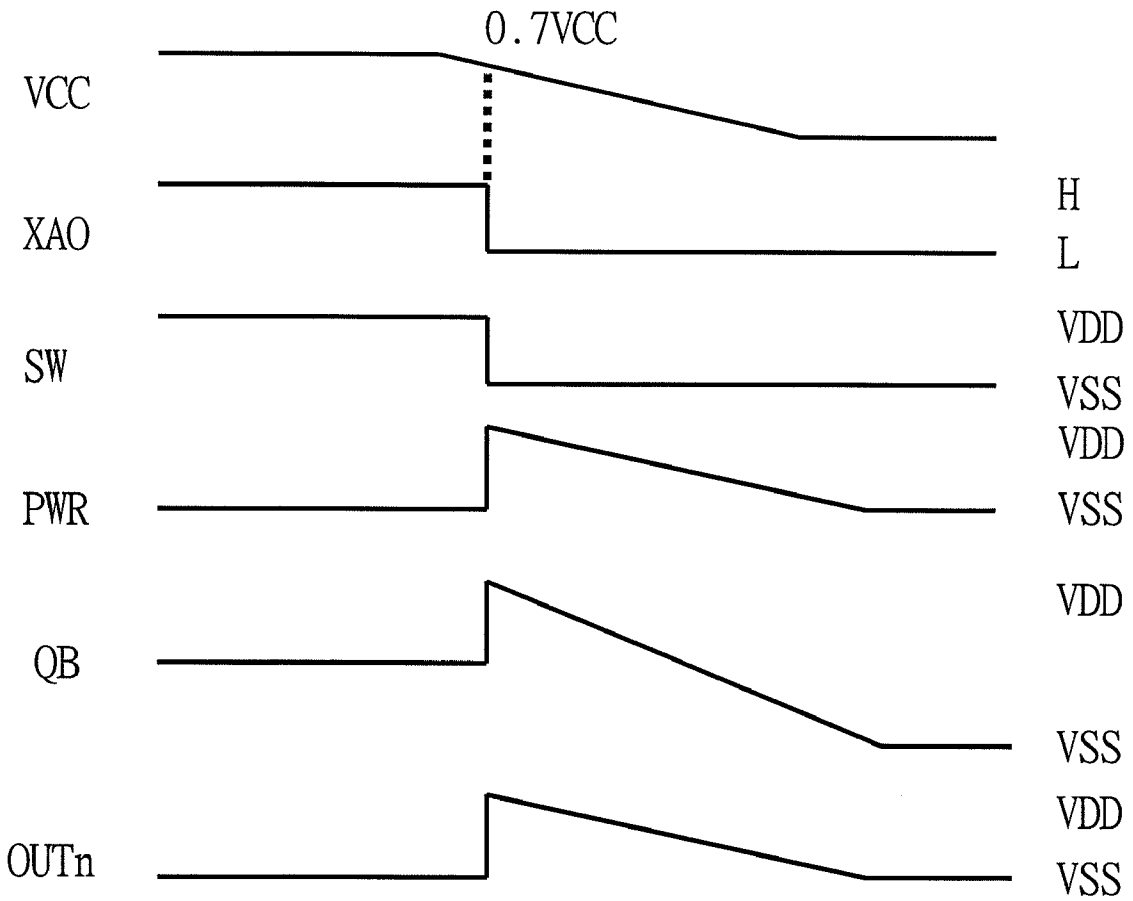
FIG. 16 is a timing chart showing timings of signals in the shift register 132*yn* of FIG. 15.

FIG. 16 is a timing chart showing timings of signals in the shift register 132*yn* of FIG. 15. As shown in FIG. 16, when the flat panel display 130 is turned off (i.e., the operation voltage VCC is lowered, e.g., by 30%), the off-controlling signal XAO is transformed from the high-level voltage H to the low-level voltage L so that the power voltage PWR outputted from the first multiplexer 1311 is transformed to the high working voltage VDD to make the second transistor M2 turn on, and the $n^{th}$ output signal OUTn outputs the high working voltage VDD to make the pixel electrodes discharge. Thus, the residual image after the LCD is turned off can be eliminated. In addition, the switch voltage SW outputted from the second multiplexer 1312 is transformed to the low working voltage VSS, the fourth transistor M4 is turned off and the power voltage PWR makes the fifth transistor M5 turn on. Thus, the set terminal ST is electrically connected to the low working voltage VSS, and a voltage level of the inverting output terminal QB is held on the high working voltage VDD.

The flat panel display according to each embodiment of the invention can use a gate driving device manufactured by the amorphous silicon manufacturing process, and can make all the pixel electrodes discharge according to the off-controlling signal to eliminate the residual image generated when the flat panel display, e.g., a TFT LCD, is turned off.

While the invention has been described by way of example and in terms of embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flat panel display, comprising:

a plurality of pixel electrodes;

a first multiplexer for receiving a high working voltage and a low working voltage and controlled by an off-controlling signal to output an input low power voltage;

a second multiplexer for receiving the high working voltage and a zeroth clock signal and controlled by the off-controlling signal to output a zeroth input clock signal;

a third multiplexer for receiving the high working voltage and a first clock signal and controlled by the off-controlling signal to output a first input clock signal; and at least a gate driver having an amorphous silicon gate structure and (N+1) shift registers, wherein N is a positive integer and n is a positive integer ranging from 1 to (N+1), the gate driver is electrically connected to the pixel electrodes, and the $n^{th}$ shift register comprises:

a SR flip-flop, which has a set terminal, a reset terminal, an output terminal and an inverting output terminal, and is electrically connected to the high working voltage and the low working voltage, wherein the set terminal is coupled to an $(n-1)^{th}$ output signal of the $(n-1)^{th}$ shift register, the reset terminal is coupled to an $(n+1)^{th}$ output signal of the $(n+1)^{th}$ shift register;

a first transistor, which is formed on a glass substrate and has a control terminal coupled to the output terminal and a first terminal for receiving an $M^{th}$ input clock signal, wherein M=1 if n is even and M=0 if n is odd; and a second transistor formed on the glass substrate, wherein the second transistor has a control terminal coupled to the inverting output terminal, a first terminal coupled to a second terminal of the first transistor for outputting an $n^{th}$ output signal, and a second terminal coupled to receive the input low power voltage, wherein:

in response to the off-controlling signal being transformed from a high-level voltage to a low-level voltage when the flat panel display is turned off, the input low power voltage outputted from the first multiplexer is transformed to the high working voltage, the zeroth input clock signal outputted from the second multiplexer is transformed to the high working voltage, the first input clock signal outputted from the third multiplexer is transformed to the high working voltage to make the first transistor or the second transistor of the $n^{th}$ shift register turn on and output the $n^{th}$ output signal at the high working voltage to cause discharge of the pixel electrodes connected to the $n^{th}$ shift register.

2. The flat panel display according to claim 1, further comprising a printed circuit board having a voltage detecting circuit for detecting a variation of an operation voltage and thus outputting the off-controlling signal.

3. The flat panel display according to claim 2, wherein when the flat panel display is turned off, the voltage detecting circuit outputs the off-controlling signal as the low-level voltage when the operation voltage is lowered by 30%.

4. A flat panel display, comprising:

a plurality of pixel electrodes;

a first multiplexer for receiving a high working voltage and a low working voltage and being controlled by an off-controlling signal to output a power voltage;

a second multiplexer for receiving the low working voltage and an initial voltage and being controlled by the off-controlling signal to output a zeroth trigger signal; and at least a gate driver having an amorphous silicon gate structure and (N+1) shift registers, wherein N is a positive integer and n is a positive integer ranging from 1 to (N+1), the gate driver is electrically connected to the pixel electrodes, and the $n^{th}$ shift register comprises:

a SR flip-flop, which has a set terminal, a reset terminal, an output terminal and an inverting output terminal and is electrically connected to the high working voltage and the low working voltage, wherein the set terminal is coupled to an $(n-1)^{th}$ trigger signal of the $(n-1)^{th}$ shift register, and the reset terminal is coupled to an $(n+1)^{th}$ output signal of the $(n+1)^{th}$ shift register;

a first transistor formed on a glass substrate and has a control terminal coupled to the output terminal and a first terminal for receiving an $M^{th}$ clock signal, wherein M=1 if n is even and M=0 if n is odd;

a second transistor formed on the glass substrate, wherein the second transistor has a control terminal coupled to the inverting output terminal, a first terminal coupled to a second terminal of the first transistor for outputting an $n^{th}$ output signal, and a second terminal coupled to receive the power voltage;

a third transistor formed on the glass substrate, wherein the third transistor has a first terminal coupled to the control terminal of the second transistor, and a second terminal coupled to a control terminal of the third transistor and coupled to receive the power voltage;

a first capacitor coupled between the first terminal of the second transistor and the control terminal of the second transistor;

a second capacitor coupled between the second terminal of the second transistor and the control terminal of the second transistor;

a fourth transistor formed on the glass substrate, wherein the fourth transistor has a control terminal coupled to the output terminal, and a first terminal coupled to the $M^{th}$ clock signal; and a fifth transistor formed on the glass substrate, wherein the fifth transistor has a control terminal coupled to the inverting output terminal, a first terminal coupled to a second terminal of the fourth transistor for outputting an $n^{th}$ trigger signal, and a second terminal coupled to the low working voltage, wherein:

in response to the off-controlling signal being transformed from a high-level voltage to a low-level voltage when the flat panel display is turned off, the power voltage outputted from the first multiplexer is transformed to the high working voltage to make the second transistor of the $n^{th}$ shift register turn on and output the $n^{th}$ output signal at the high working voltage to cause discharge of the pixel electrodes connected to the $n^{th}$ shift register; and make the fifth transistor turn on so that the $n^{th}$ trigger signal outputted from the fifth transistor is held on the low-level voltage.

5. The flat panel display according to claim 4, further comprising a printed circuit board having a voltage detecting circuit for detecting a variation of an operation voltage and thus outputting the off-controlling signal.

6. The flat panel display according to claim 5, wherein when the flat panel display is turned off, the voltage detecting circuit outputs the off-controlling signal as the low-level voltage when the operation voltage is lowered by 30%.

7. A flat panel display, comprising:

a plurality of pixel electrodes;

a first multiplexer for receiving a high working voltage and a low working voltage and being controlled by an off-controlling signal to output a power voltage;

a second multiplexer for receiving the high working voltage and the low working voltage and being controlled by the off-controlling signal to output a switch voltage; and at least a gate driver having an amorphous silicon gate structure and (N+1) shift registers, wherein N is a positive integer and n is a positive integer ranging from 1 to (N+1), the gate driver is electrically connected to the pixel electrodes, and the $n^{th}$ shift register comprises:

a SR flip-flop, which has a set terminal, a reset terminal, an output terminal and an inverting output terminal and is electrically connected to the high working voltage and the low working voltage, wherein the reset terminal is coupled to an $(n+1)^{th}$ output signal of the $(n+1)^{th}$ shift register;

a first transistor formed on a glass substrate, wherein the first transistor has a control terminal coupled to the output terminal and a first terminal for receiving an $M^{th}$ clock signal, wherein M=1 if n is even and M=0 if n is odd;

a second transistor formed on the glass substrate, wherein the second transistor has a control terminal coupled to the inverting output terminal, a first terminal coupled to a second terminal of the first transistor for outputting an $n^{th}$ output signal, and a second terminal coupled to receive the power voltage;

a third transistor formed on the glass substrate, wherein the third transistor has a first terminal coupled to the control terminal of the second transistor, and a second terminal coupled to a control terminal of the third transistor and coupled to the power voltage;

a first capacitor coupled to the first terminal of the second transistor and the control terminal of the second transistor;

a second capacitor coupled to the second terminal of the second transistor and the control terminal of the second transistor;

a fourth transistor formed on the glass substrate, wherein the fourth transistor has a control terminal coupled to receive the switch voltage, a first terminal coupled to the set terminal, and a second terminal coupled to an $(n-1)^{th}$ output signal of the $(n-1)^{th}$ shift register; and a fifth transistor formed on the glass substrate, wherein the fifth transistor has a control terminal coupled to the power voltage, a first terminal coupled to the first terminal of the fourth transistor, and a second terminal electrically connected to the low working voltage, wherein:

in response to the off-controlling signal being transformed from a high-level voltage to a low-level voltage when the flat panel display is turned off, the power voltage outputted from the first multiplexer is transformed to the high working voltage and the switch voltage outputted from the second multiplexer is transformed to the low working voltage to make the second transistor of the $n^{th}$ shift register turn on and output the $n^{th}$ output signal at the high working voltage to cause discharge of the pixel electrodes connected to the $n^{th}$ shift register.

8. The flat panel display according to claim 7, further comprising a printed circuit board having a voltage detecting circuit for detecting a variation of an operation voltage and thus outputting the off-controlling signal.

9. The flat panel display according to claim 8, wherein when the flat panel display is turned off, the voltage detecting circuit outputs the off-controlling signal as the low-level voltage when the operation voltage is lowered by 30%.

* * * * *